United States Patent [19]

Amberg et al.

[11] 4,210,256

[45] Jul. 1, 1980

[54] POUR SPOUT LID

[75] Inventors: Christopher P. Amberg, Sylvania, Ohio; Samuel L. Belcher, Clementon, N.J.

[73] Assignee: Owens-Illinois, Inc., Toledo, Ohio

[21] Appl. No.: 55,719

[22] Filed: Jul. 9, 1979

[51] Int. Cl.[2] ..... B65D 41/48; A47K 19/22

[52] U.S. Cl. ..... 220/254; 220/90.4; 220/268; 220/281; 229/7 R

[58] Field of Search ..... 220/90.4, 254, 268, 220/269, 281, 339; 229/7 R; 222/556

[56] References Cited

U.S. PATENT DOCUMENTS

| | | | |
|---|---|---|---|
| 4,081,103 | 3/1978 | Zoellick | 229/7 R X |
| 4,095,712 | 6/1978 | Perrella | 220/254 |
| 4,113,135 | 9/1978 | Yamazaki | 220/90.4 X |

*Primary Examiner*—George T. Hall

*Attorney, Agent, or Firm*—David R. Birchall; Myron E. Click; David H. Wilson

[57] ABSTRACT

A lid adapted to fit over the opening of a container with an opening therein which permits the contents of the container to be poured therethrough. A tab fitted into the opening in the lid and attached toward the center of the lid. A force applying area positioned in the central portion of the lid and attached to the tab so that the tab moves in an inward direction when a force is applied to the top of the lid. When the force is released from the top of the lid, the tab then assumes its original position within the opening, thus preventing the spilling of the contents within the container to which the lid is applied.

12 Claims, 3 Drawing Figures

POUR SPOUT LID

BACKGROUND OF THE INVENTION

The present invention relates to closures in general for containers. In particular, the invention is concerned with a closure adapted for use with containers associated with the soft drink and diary industry.

There has been a need in the art to provide a closure that can be readily attached to a container such as a paper or plastic cup, yet permit pouring of the contents of the container without the necessity of removing the closure from the container.

The prior art recognizes several container closures with apertures located therein which aid in the dispensing of fluids or granular material from the container to which the closure is attached. One example of a lid with a hinged valve therein is U.S. Pat. No. 4,113,135 issued Sept. 12, 1978. In this particular patent, the valve is actuated by applying an inward force toward the outer or free end of the cantilevered valve. While this particular design is adequate for drinking from a container through the provided aperture, the arrangement does not work well as a finger actuated pour spout because the liquid contents will invariably come into contact with the finger as the valve is moved to the open position.

Then too, there is the prior art container and lid combination shown in U.S. Pat. No. 2,176,898 which depicts an elongate tab which can be pushed by the finger to an open position, thus permitting the contents of the container to be poured. This particular tab arrangement would appear to serve as an arrangement for providing an opening in the top of a can or container, however, it would not appear to possess the resiliency or structure to permit the tab to return to a closed position.

SUMMARY OF THE INVENTION

In accordance with the present invention, there is provided a closure with a pour spout that is finger actuated. The closure permits the pouring of a liquid or granular material from a container by merely depressing the central area of the closure, thus opening the pour spout. When the pressure is removed from the center of the closure, the opening is once again closed, thus preventing the splashing of material from the container to which the closure is attached. The closure has a raised central portion to which a cantilevered flap is attached. A series of ribs are also attached to the central portion, as well as the rim of the container. The ribs provide the structural means whereby the closure and associated pour spout has a tendency to seek its original configuration after the center of the closure has been depressed to open the pour spout.

DESCRIPTION OF THE PREFERRED EMBODIMENT

Figure 1:
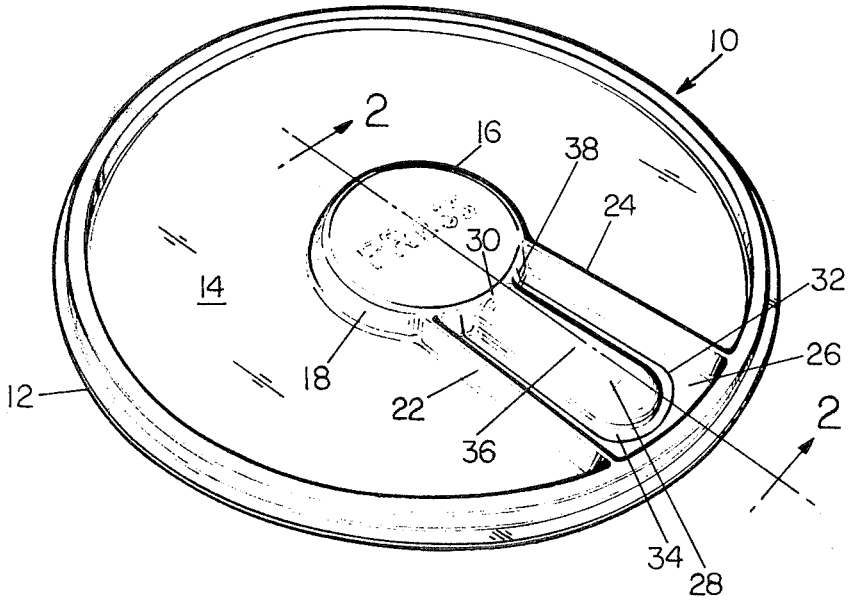
FIG. 1 is a top perspective view of the closure in accordance with the present invention.
Figure 2:
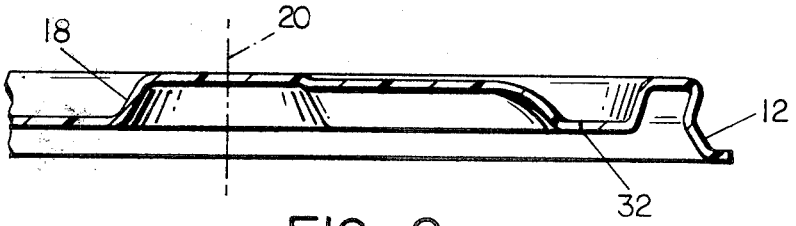
FIG. 2 is a cross sectional view taken along the lines 2—2 of FIG. 1.

The closure of the present invention is shown generally at 10 in FIG. 1. A rim 12 is positioned circumferentially around closure 10 and permits it to lock into engagement with the beaded portion of a container to which the closure is adapted to fit. Closure 10 contains a generally planar central area 14 that is attached to the lower inside of rim 12. The planar central area 14 contains a centrally positioned load applying area 16. The load applying area 16 is raised above the surface of planar central area 14 as can readily be seen in FIG. 1. A generally inclined wall 18 surrounds the load applying area 16. Wall 18 slopes upward from planar central region 14 toward the central vertically aligned axis 20 of the closure which is depicted in FIGS. 1 and 2.

A pair of ribs 22 and 24 is in spaced apart relationship to one another and connect the load applying area 16 to the rim 12. The ribs 22 and 24 may be of different configuration than depicted so long as their structure permits easy removal from the tools upon which the closure is manufactured.

Since ribs 22 and 24 are spaced apart one from the other, there is defined a smaller planar area which is identified by numeral 26. This area 26 is bounded on two sides by the ribs 22 and 24, the exterior rim 12 and the peripheral edge 18 of the load applying area.

A valve 28 is positioned centrally between ribs 22 and 24. The valve 28 is cantilevered from the load applying area 16 and, of course, is rigidly attached to that portion of peripheral edge 18 which bounds the smaller planar area 26. The attachment of valve 28 to the sloping wall 18 of load applying area 16 is shown at 30. The valve 28 is provided freedom by a die cut 32 which severs it from attachment to smaller area 26 except at the attachment point 30. The valve 28 also has a small planar rim 34 that traverses the entire external extent of valve 28 except the attachment point 30 on sloping wall 18 of the load applying area 16. The rigidity of valve 28 is maintained by an upwardly elongate domed section 36.

Returning now to the die cut 32 which separates the valve 28 from the smaller area 26, it can be observed the die cut 32 also extends upward across the sloping wall 18 as shown at 38.

Figure 3:
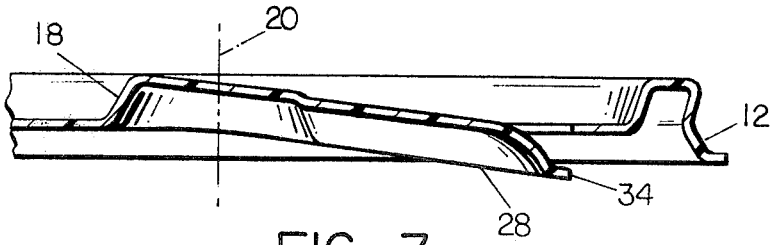
FIG. 3 is a similar cross sectional view taken along the lines 2—2 of FIG. 1 showing the pour spout in the open position.

When pressure is applied in the downward direction on the load applying area 16, the edge of the load applying area 16 will undergo a rotation, thus causing the attached valve 28 to immediately move its planar rim 34 below the surface of the smaller planar area 26. Thus, by simultaneously pressing the load applying area 16 and tipping the container to which closure 10 has been applied, the contents held by the container can be poured freely through the opening thus produced by depressed valve 28. This opening is clearly shown in FIG. 3. As pressure is released from the load applying area 16, the valve immediately returns to its original position where rim 34 is in juxtaposed position to the die cut situated in smaller planar area 26.

The closure 10 may be manufactured by matched metal dies, or more conveniently, by the well known thermoforming process wherein heated sheet stock is drawn by vacuum means over a mold of the desired configuration. After the thermoplastic sheet stock has been formed, it is subjected to a die cutting operation that severs the closure 10 from the sheet stock. The same die cutting operation also makes die cut 32, thus providing freedom of movement for valve 28. The geometry of valve 28 and the load applying area 16 is such that the closure and its accompanying valve 28 will withstand a repetitive number of openings and closings before it fails.

From the above description of the preferred embodiment of the present invention, it will have become apparent that this particular invention provides a closure having great utility and durability while retaining the simplicity of design and construction which adapts to manufacture by the thermoforming process.

The configuration of the dispensing valve 28 and its attached load applying area 16 also lends itself to a closure that can be stacked for the conservation of space, as well as for various mechanical lid applying techniques.

What is claimed is:

1. A closure with a rim adapted to engage the top of a container comprising:

a generally planar central area attached to said rim, a centrally positioned load applying area connected to said planar central area and positioned at an elevation different than said central area, a plurality of ribs connecting said load applying area to said rim, a valve positioned between said ribs and attached in cantilevered fashion to said load applying area whereby said valve can be opened when pressure is applied to said load applying area.

2. A closure as claimed in claim 1 wherein said planar central area is positioned below the topmost portion of said rim.

3. A closure as claimed in claim 2 wherein said areas are connected to each other by a wall inclined with respect to said areas.

4. A closure with a rim adapted to engage the top of a container comprising:

a generally planar central area attached to said rim and positioned below the topmost portion of said rim, a centrally positioned load applying area connected to said planar central area by a wall inclined with respect to said planar central area and the top of said load applying area, a plurality of spaced apart ribs formed in said planar central area and connected at one end to said rim and connected at the other end to said wall, a valve positioned between said ribs with one end attached to said wall and its free end positioned adjacent said rim, whereby said valve moves to an open position when a downward force is applied to said load applying area and moves to a closed position when the applied force is removed.

5. A closure as claimed in claim 4 wherein said valve has a curved central section to provide rigidity throughout its length.

6. A closure as claimed in claim 4 wherein said valve contains a planar rim in juxtaposed relationship to the planar area of said closure.

7. A closure as claimed in claim 5 wherein the valve is of convex configuration on its top side.

8. A closure as claimed in claim 4 wherein a die cut is positioned adjacent the sides and free end of said valve.

9. A closure as claimed in claim 4 wherein a die cut is placed in that section of the inclined wall which is positioned between said valve and said ribs.

10. A closure made of resilient plastic material having a rim adapted for coacting with the top edge of an open container, an upwardly extending load applying area positioned in the central area of the closure and connected by an inclined wall to first and second planar areas, at least two reinforcement ribs connected to said centrally positioned load applying area and the peripheral rim of said closure, said first planar area extending over the greater portion of the closure top and attached to and surrounding the greater portion load applying area, a second smaller planar area situated between said ribs, a valve positioned between said ribs and attached at one end to said load applying area, said valve containing a planar rim in juxtaposed position with said second planar area, a die cut in said second planar area which separates said valve from said second planar area except where said valve is joined to said load applying area, thus permitting said valve to move to an inward position when pressure is applied to said load applying area.

11. A closure as claimed in claim 10 wherein the die cut extends across the inclined wall between said ribs and said valve, thus providing a degree of flexibility for the downward movement of the valve.

12. A closure as claimed in claim 11 wherein the valve is of convex configuration on its top side.

* * * * *